US005337800A

United States Patent [19]

Cook

[11] Patent Number: 5,337,800

[45] Date of Patent: Aug. 16, 1994

[54] REACTIVE COATING

[76] Inventor: Arnold J. Cook, 801 James Way, Mt. Pleasant, Pa. 15666

[21] Appl. No.: 943,405

[22] Filed: Sep. 9, 1992

[51] Int. Cl.[5] ..... B22D 19/14; B22C 3/00

[52] U.S. Cl. ..... 164/72; 164/55.1; 164/97; 164/122.1

[58] Field of Search ..... 164/14, 55.1, 57.1, 164/58.1, 59.1, 72, 97, 121, 138, 122, 122.1

[56] References Cited

U.S. PATENT DOCUMENTS

| | | | |
|---|---|---|---|
| 1,325,725 | 12/1919 | Kohler et al. | 164/55.1 |
| 1,374,509 | 4/1921 | Lomax | 164/55.1 |
| 1,677,979 | 7/1928 | Mitchell | 164/58.1 |
| 2,250,488 | 8/1933 | Lerig et al. | 164/58.1 |
| 3,515,201 | 6/1970 | Zimmerman | 164/72 |
| 3,645,767 | 2/1972 | Taylor | 164/72 |
| 3,802,482 | 4/1974 | Phipps, Jr. | 164/72 |
| 3,848,847 | 11/1974 | Komatsu et al. | 164/72 |
| 4,034,464 | 7/1977 | Hetke | 164/58.1 |
| 4,298,051 | 11/1981 | Page | 164/72 |
| 4,413,666 | 11/1983 | Page | 164/72 |
| 4,556,098 | 12/1985 | Hintermann et al. | 164/138 |
| 4,961,458 | 10/1990 | Downing | 164/72 |
| 5,119,864 | 6/1992 | Langensiepen | 164/97 |
| 5,133,494 | 7/1992 | Wang et al. | 164/97 |

FOREIGN PATENT DOCUMENTS

| | | | |
|---|---|---|---|
| 2345253 | 11/1977 | France | 164/122.1 |

*Primary Examiner*—P. Austin Bradley
*Assistant Examiner*—Erik R. Puknys
*Attorney, Agent, or Firm*—Ansel M. Schwartz

[57] ABSTRACT

The present invention pertains to a system for casting a melted material. The system has a mold having a mold cavity for forming the melted material. There is a coating disposed about the mold cavity which chemically reacts with the melted material such that the melted material cannot react with mold. In this manner, the cast part can be more easily released from the mold, since it cannot chemically react with it. The present invention is also a method of casting a melted material. The method comprises the step of coating a mold cavity of a mold with a material which is chemically reactive with the melted material. Next, there is the step of introducing melted material into the mold cavity such that melted material infiltrates and chemically reacts with the material on the mold to form a composite skin which prevents the melted material from chemically reacting with the mold. Then, there can be the step of cooling the melted material. Preferably, before the introducing step, there is the step of disposing reinforcement within the mold and the introducing step is such that a pure material layer is formed between the composite skin and the infiltrated reinforcement. If desired, the composite skin can be removed or left on to protect the part.

30 Claims, 3 Drawing Sheets

REACTIVE COATING

FIELD OF THE INVENTION

The present invention is related in general to casting. More specifically, the present invention is related to a coating disposed about a mold cavity of a mold which chemically reacts with cast material introduced therein to inhibit the adherence of the cast material to the mold.

BACKGROUND OF THE INVENTION

Molten metal will chemically react and alloy with almost any material it comes in contact with. As an example, molten aluminum exhibits extreme chemical reactivity when melted and will alloy and dissolve with most other metals such as steel and copper even though they have a much higher melting point. Typically, mold temperatures are kept to a minimum so that the molten metal cools before any substantial chemical reaction occurs.

It is known to apply mold coatings to a mold to prevent adhesion of the part to the mold. This is typically accomplished by lubricating the mold with a coating that is non-reactive with the metal and one that will provide a slippage layer, void of the metal, so that the metal part will release from the mold. Coatings are typically comprised of a multitude of fine particles which are applied to the mold suspended in a liquid, such as water or alcohol. Coatings for low pressure metal castings typically act to stop the metal from passing through the particles of the coating because the metal does not wet with the ceramic particles and there is not sufficient pressure to infiltrate the particles. As an example, boron nitride spray is often used as a release coating for aluminum and graphite spray is typically used for copper castings because of its low solubility.

Unfortunately, lubricant spray coatings do not work well when the mold is subject to high temperature and pressures. For example, in Pressure Infiltration Casting TM (PIC) as disclosed in U.S. Pat. No. 5,111,871, molds must be used at temperatures near or above the melting point of the metal to be cast so the mold will not cause the metal to solidify when it contacts the mold. This is accomplished by maintaining the mold within a heated pressure vessel. In order to completely fill the cavities in the mold and/or infiltrate any preforms of reinforcement material disposed in the mold, high pressures must be used. The high temperatures, in excess of 400° C., and pressures, in excess of 50 PSI, cause the metal to be very reactive with mold surfaces and thus adherence of the metal to the mold is a major problem which, as yet, has not being satisfactorily overcome.

The present invention provides a coating for a mold which is specifically adapted to react with the outer surface of the molten material to exhaust its reactive potential before it can react the mold. In this manner, the part is prevented from adhering to the mold.

SUMMARY OF THE INVENTION

The present invention pertains to a system for casting a melted material. The system is comprised of a mold having a mold cavity for forming the melted material. There is a coating disposed about the mold cavity which chemically reacts with the melted material such that the melted material cannot react with mold.

The present invention is also a method of casting a melted material. The method comprises the step of first coating a cavity of a mold with a material which is chemically reactive with the melted material. Next, there is the step of introducing melted material into the mold cavity such that melted material infiltrates and chemically reacts with the material on the mold to prevent the melted material from chemically reacting with the mold. Then, there can be the step of cooling the melted material. The mold cavity can have reinforcement material disposed within. The material on the mold serves to block mold adhesion even during reinforcement and mold infiltration.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
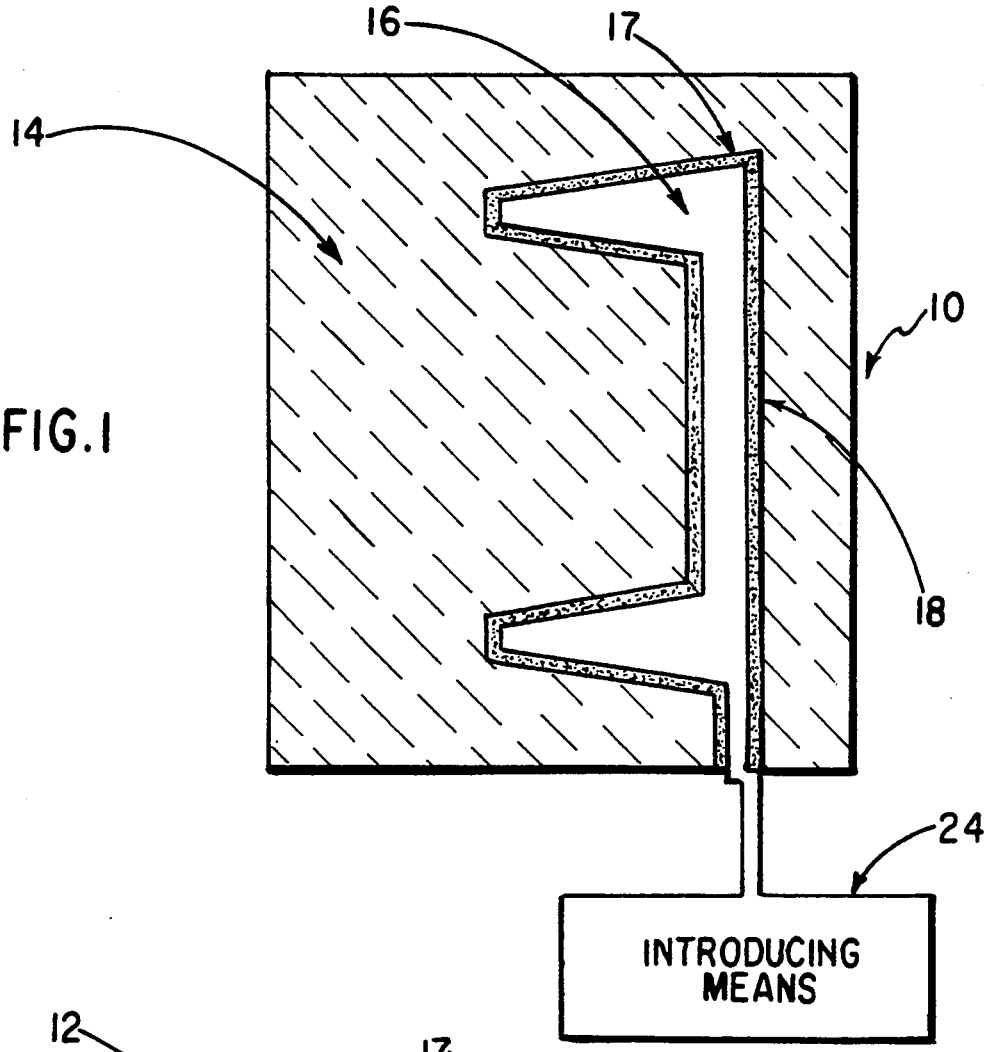
FIG. 1 is a schematic representation showing a cross section of the system for casting.
Figure 2:
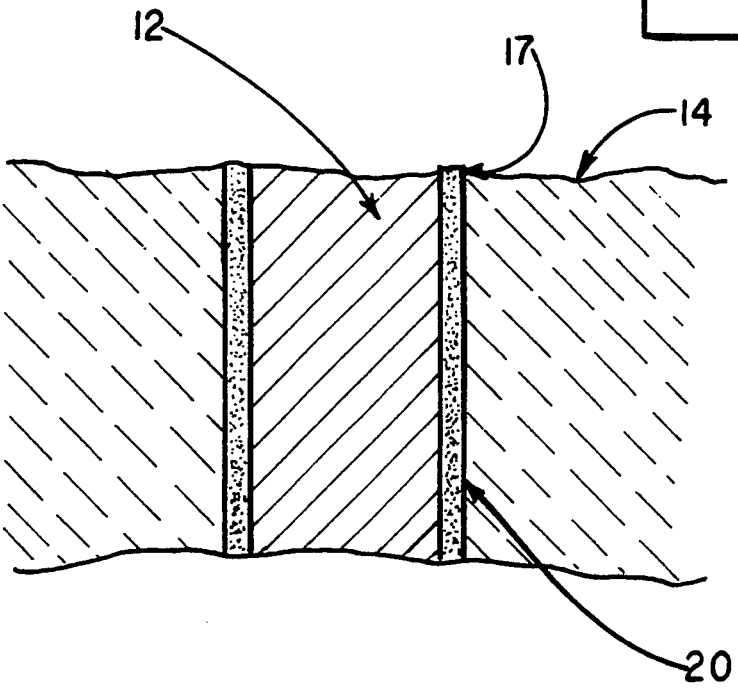
FIG. 2 is a schematic representation showing a cross section of the surfaces of the mold, the composite skin, and the material.

Referring now to the drawings wherein like reference numerals refer to similar or identical parts throughout the several views, and more specifically to FIGS. 1 and 2 thereof, there is shown a system 10 for casting a melted material 12 such as aluminum or copper. The system is comprised of a mold 14 having a mold cavity 16 for forming the melted material 12. There is a coating 18 disposed about the mold cavity 16. The coating 18 chemically reacts with the melted material 12 such that the melted material 12 is prevented from chemically reacting with the mold 14 when introduced into the mold cavity 16. In this manner, the finished part can be removed from the mold 14 without sticking thereto. The system 10 also has a mechanism 24 for introducing the melted material into the mold 14. The mold 14 can be a porous mold made, for instance, of graphite.

Preferably, the coating 18 is comprised of particles which have a length of between ½–5 microns. This allows for a generous amount of particle surface area with which the melted material 12 can react when these particles are infiltrated. The particles, for instance, can be comprised of graphite, ceramic or metal or a combination of these, though the composition of the particles is not limited to these examples. What is essential is that the particles react with the specific melted material 12. Preferably, the introducing a mechanism includes a mechanism to force the material into the mold 14. In this manner, reinforcement material 22 disposed within the mold cavity 16 can be sufficiently infiltrated, as shown in FIG. 3, if desired.

The present invention is also a method of casting a melted material 12. The method comprises the step of coating a mold cavity 16 of a mold 14 with a material 18 which is chemically reactive with the melted material 12. Next, there is the step of introducing the melted material 12 into the mold cavity 16 such that melted material 12 infiltrates and chemically reacts with the material 18 about the mold cavity 16 to prevent the melted material 12 from reacting with the mold 14. Then, there is the step of cooling the melted material 12. During the introducing step, as shown in FIG. 2, the chemical reaction between the melted material 12 and the material 18 on the mold 14 forms a composite skin 20.

Preferably, after the cooling step, there is the step of removing the composite skin 20 from the material 12 and before the introducing step, there is the step of heating the mold 14 with, for instance, resistance or RF coils disposed about the mold (not shown). The coating step can include the steps of mixing coating particles with a liquid and binder to form a mixture, applying the mixture to the mold and evaporating or curing the liquid such that the coating particles remain on the mold cavity 16. Preferably, the cooling step includes the step of directionally solidifying the melted material 12, such as with a lift chill as described in U.S. Pat. No. 5,111,870, incorporated by reference.

Figure 3:
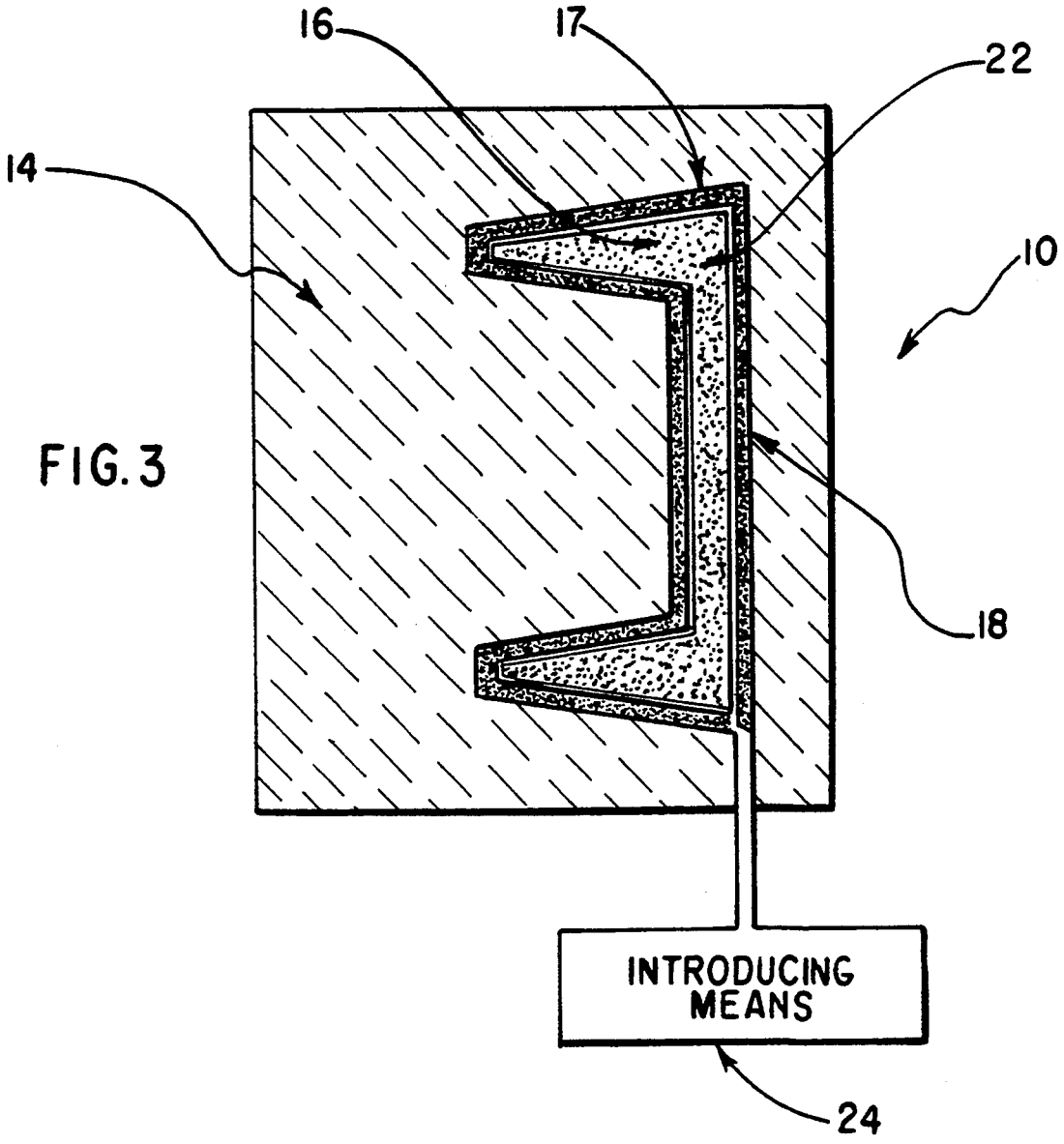
FIG. 3 is a schematic representation showing a cross section of the system for casting with reinforcement material.
Figure 4:
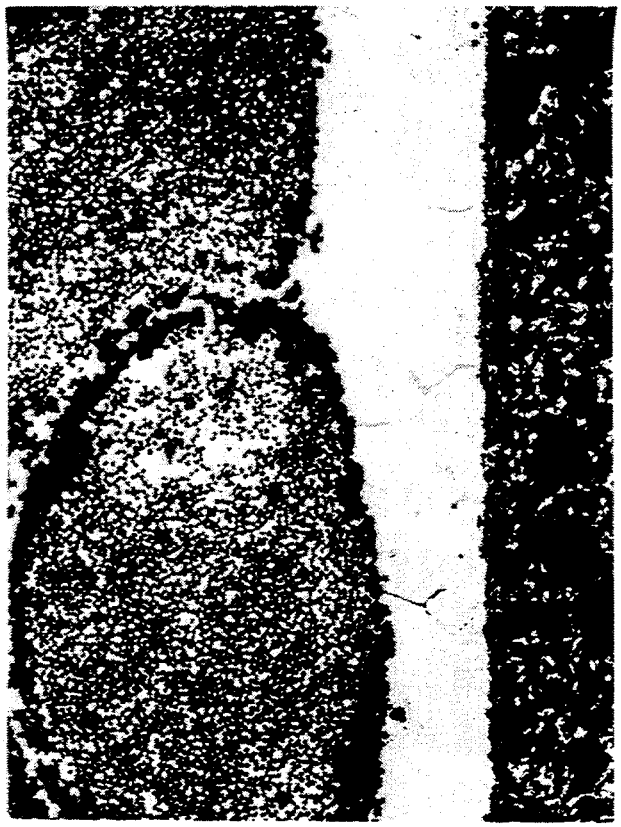
FIG. 4 is a copy of a magnified photograph showing the mold, the composite skin, the pure material layer and the reinforcement infiltrated with the material.
Figure 5:
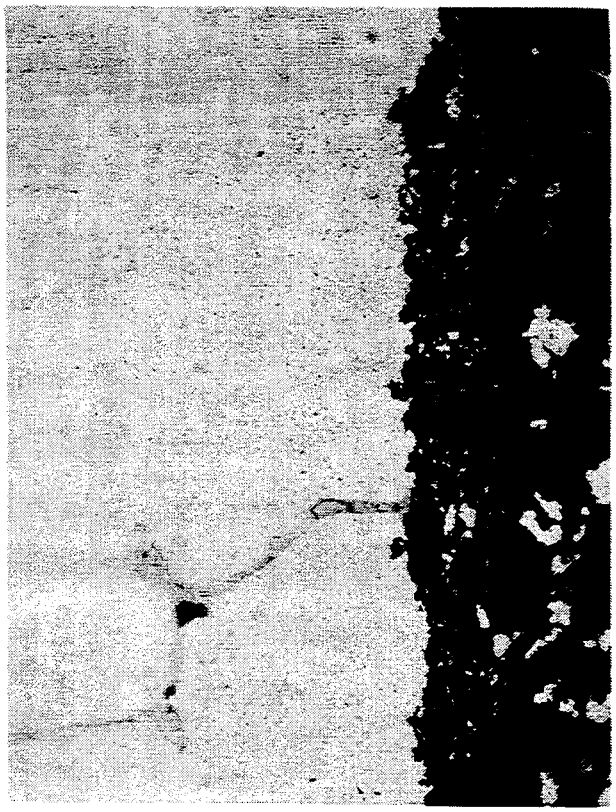
FIG. 5 is a copy of a magnified photograph showing the mold, the composite skin and the pure material layer.

Preferably, as shown in FIG. 3, reinforcement material 22 is disposed in the mold cavity 16. If desired during the introducing step, the melted material 12 in the mold cavity 16 can be made to push the reinforcement material 22 away from the walls 17 of the mold 14 such that a pure material layer 30 is formed between the infiltrated reinforcement 22 and the composite skin 20. This is shown in FIGS. 4 and 5 which are copies of magnified photographs. Note, the mold 14 is porous. The chemical reaction between the particles and the melted material formed a composite skin 20 which prevented bonding of the metal with the of the porous mold 14.

In the preferred operation of the invention, the mold 14 is made of 2020 graphite but of course the mold 14 can be made of many materials including ceramic, graphite or other metals such as steel, etc. The walls 17 of the mold 14 defining the mold cavity 16 are polished. Polishing is important because it has been shown in practice that the more polished is the surface of the walls 17, the more easily the part releases from the mold 14. The walls 17 are then coated with a mixture of 1–5 micron graphite particles and water. The size of the graphite particles is preferably as small as possible to provide a generous amount of surface area with which the melted material 12, which is aluminum, can react. Plate shaped particles have shown excellent results. The water is then allowed to evaporate, leaving a thin coating 18 on the walls 17 of the mold 14. SiC reinforcement material 22 is next placed within the mold cavity 16. The mold 14 is then heated to 700° C. Molten aluminum is forced into the mold cavity 16 under pressure to infiltrate the reinforcement material 22. The molten aluminum, upon contact with the coating 18 infiltrates the coating and chemically reacts with the graphite particles to form aluminum carbide.

The chemical reaction between the aluminum and the mold coating 18 serves two purposes, both of which aid in preventing the solidified part from adhering to the mold 14. First, the coating 18 exhausts the reactive potential of the melted aluminum's outer surface so that it is difficult for the melted aluminum to chemically react with the graphite of the mold 14. Second, the reaction between the coating 18 and melted aluminum forms a composite outer skin 20.

The melted aluminum is then directionally solidified. Once cooled, the part is comprised of aluminum solidified about a matrix of SiC particles and a composite skin 20 which is comprised of aluminum carbide. The part is then separated from the mold 14. It should be noted that the coating 18 must be applied before each casting.

The reacted composite skin 20 can be left on or mechanically removed, for example, with a sandblaster, or etched away with nitric acid. It should be noted that ceramic and/or metal particles can be used to exhaust the chemical reaction of the melted material 12. For instance, boron nitride particles can be used as the coating 18 when using copper as the melted material 12.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A system for casting a melted material comprising:

a mold having a mold cavity within which the melted material is formed;

a coating disposed about the mold cavity which chemically reacts with the melted material such that the melted material is prevented from chemically reacting with the mold, said coating comprised of plate shaped particles having a length of ½–5 microns;

a mechanism for introducing the melted material into the mold such that the melted material infiltrates through the coating to the mold and chemically reacts with the coating to prevent the melted material from chemically reacting with the mold, said introducing mechanism in fluidic communication with the mold; and a mechanism for heating the mold to a temperature above the melting temperature of the melted material while the melted material is introduced into the mold by the introducing mechanism.

2. A system as described in claim 1 wherein the particles are comprised of graphite.

3. A system as described in claim 1 wherein the particles are comprised of ceramic.

4. A system as described in claim 1 wherein the particles are comprised of metal.

5. A system as described in claim 1 wherein the particles are comprised of boron nitride.

6. A system as described in claim 1 wherein the particles are comprised of a mixture of graphite, ceramic and metal.

7. A system as described in claim 1 wherein the introducing mechanism includes a mechanism to force the material into the mold.

8. A system as described in claim 7 including reinforcement material disposed in the mold cavity.

9. A system as described in claim 1 wherein the mold is a porous mold.

10. A system as described in claim 1 wherein the mold is comprised of graphite.

11. A system as described in claim 1 wherein the mold is comprised of a composite.

12. A system as described in claim 1 wherein the mold is comprised of a ceramic.

13. A system as described in claim 1 wherein the mold is comprised of a metal.

14. A method of casting a melted material comprising the steps of:

coating a mold cavity of a mold with a coating material which is chemically reactive with the melted material, said coating comprised of plate shaped particles having a length of ½–5 microns; and introducing melted material into the mold such that the melted material infiltrates through the coating to the mold and chemically reacts with the coating material to prevent the melted material from chemically reacting with the mold.

15. A method as described in claim 14 including after the introducing step, the step of cooling the melted material.

16. A method as described in claim 14 wherein during the introducing step, the coating material is infiltrated and chemically reacts with the melted material to form a composite skin.

17. A method as described in claim 16 wherein after the introducing step, there is the step of removing the cast material with the composite skin from the mold.

18. A method as described in claim 17 wherein after the step of removing the cast material from the mold, there is the step of removing the composite skin from the cast material.

19. A method as described in claim 17 wherein after the step of removing the cast material from the mold, there is the step of recoating the mold cavity with a material which is chemically reactive with the melted material.

20. A method as described in claim 14 wherein before the introducing step, there is the step of heating the mold to a temperature which is above the melting temperature of the melted material such that the mold is above the melting temperature of the melted material as the melted material is introduced into the mold.

21. A method as described in claim 14 wherein the introducing step includes the step of forcing the melted material into the mold.

22. A method as described in claim 14 wherein the coating step includes the steps of mixing coating particles with liquid to form a mixture, applying the mixture to the mold and evaporating or curing the liquid such that the coating particles are left behind on the mold cavity.

23. A method as described in claim 22 wherein the mixing step includes the step of mixing a binder with the coating particles and liquid.

24. A method as described in claim 23 wherein the cooling step includes the step of directionally solidifying the melted material.

25. A method as described in claim 14 wherein the mold is a porous mold.

26. A method as described in claim 14 wherein before the introducing step, there is the step of disposing reinforcement within the mold cavity.

27. A method as described in claim 26 wherein during the introducing step, a pure material layer is formed between the composite skin and the reinforcement infiltrated with the metal.

28. A method as described in claim 27 wherein after the introducing step, there is the step of removing the composite skin to expose the pure material layer.

29. A method of casting a melted material comprising the steps of:

coating a mold cavity of a mold with a material which is chemically reactive with the melted material;

disposing reinforcement within the mold cavity; and introducing melted material into the mold such that the melted material infiltrates through the coating to the mold and chemically reacts with the coating material to form a composite skin to prevent the melted material from chemically reacting with the mold and a pure material layer is formed between the composite skin and the reinforcement infiltrated with the metal.

30. A method as described in claim 29 wherein after the introducing step, there is the step of removing the composite skin to expose the pure material layer.

* * * * *